US005267413A

United States Patent [19]

Hubert et al.

[11] Patent Number: 5,267,413

[45] Date of Patent: Dec. 7, 1993

[54] REMOVABLE WINDOW MINI BARS

[76] Inventors: Sally M. Hubert, 1631 E. 84th Pl., Chicago, Ill. 60617; George Spector, 233 Broadway Rm 702, New York, N.Y. 10279

[21] Appl. No.: 905,668

[22] Filed: Jun. 29, 1992

[51] Int. Cl.[5] ..... E06B 7/00

[52] U.S. Cl. ..... 49/57; 49/82.1

[58] Field of Search ..... 49/50, 51, 57, 64, 74 L, 49/82 GR, 463, 465; 292/95, 101, 105, 206

[56] References Cited

U.S. PATENT DOCUMENTS

| | | | |
|---|---|---|---|
| 112,635 | 3/1871 | Robinson | 292/106 |
| 613,139 | 10/1898 | Grant | 292/106 X |
| 637,160 | 11/1899 | Richter | 292/105 X |
| 1,052,812 | 2/1913 | Garland | 49/51 X |
| 1,138,944 | 5/1915 | Eaton | 49/51 X |
| 1,817,126 | 8/1931 | Bruns | 49/82 GR |
| 2,311,300 | 2/1943 | Dubour et al. | 49/64 X |
| 2,646,599 | 7/1953 | Klee | 49/82 GR X |
| 2,663,585 | 12/1953 | Tye | 292/106 |
| 2,852,071 | 9/1958 | Smith | 49/50 X |
| 3,746,042 | 7/1973 | Finkel | 49/82.1 |
| 4,724,634 | 2/1988 | Blum | 49/51 |
| 4,860,492 | 8/1989 | Roy | 49/82.1 |

FOREIGN PATENT DOCUMENTS

| | | | |
|---|---|---|---|
| 101564 | 10/1923 | Switzerland | 292/101 |

*Primary Examiner*—Peter M. Cuomo
*Assistant Examiner*—Jerry Redman

[57] ABSTRACT

A removable window safety guard for a window is provided which consists of a frame mounted within a window opening between side jambs when a lower window sash is raised. A mechanism operated by a control knob is for opening and closing louvers mounted within the frame. A retainer extends between the control knob and one side jamb of the window for preventing removal of the frame from the window opening, so that a child cannot fall out and an intruder cannot enter through the window opening.

1 Claim, 1 Drawing Sheet

REMOVABLE WINDOW MINI BARS

BACKGROUND OF THE INVENTION

The instant invention relates generally to window protectors and more specifically it relates to a removable window safety guard which provides for the window to be opened during hot weather while small children cannot fall out and intruders cannot get in.

There are available various conventional window protectors which do not provide the novel improvements of the invention herein disclosed.

SUMMARY OF THE INVENTION

A primary object of the present invention is to provide a removable window safety guard that will overcome the shortcomings of the prior art devices.

Another object is to provide a removable window safety guard that is installed in an opened window during hot weather, so that small children cannot fall out of the opened window.

An additional object is to provide a removable window safety guard that includes a retainer attached between a louver operating control knob on the safety guard and the window frame to prevent an intruder from removing the safety guard and entering through the opened window.

A further object is to provide a removable window safety guard that is simple and easy to use.

A still further object is to provide a removable window safety guard that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front elevational view of a window with the instant invention installed therein.

FIG. 2 a diagrammatic cross sectional view taken along lien 2—2 in FIG. 1 showing the louver operating mechanism.

DETAILED DESCRIPTION OF THE PREFERRED EMBODIMENTS

Figure 1:
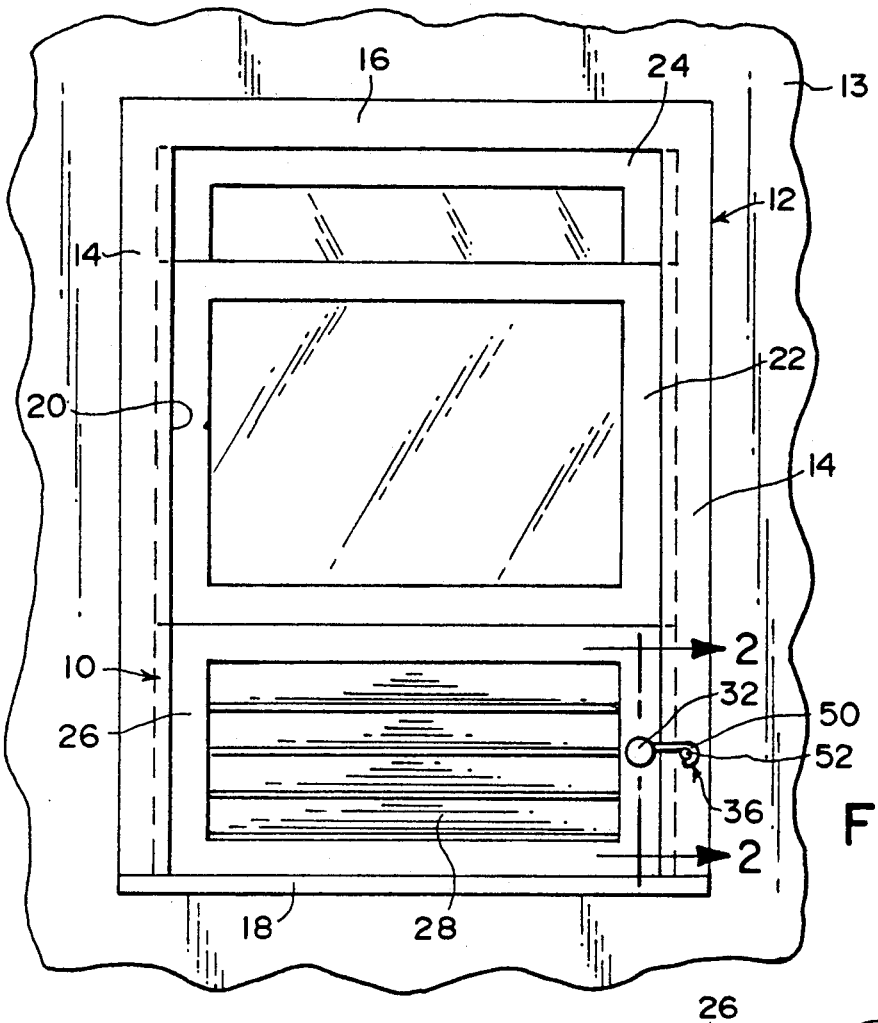
Figure 2:
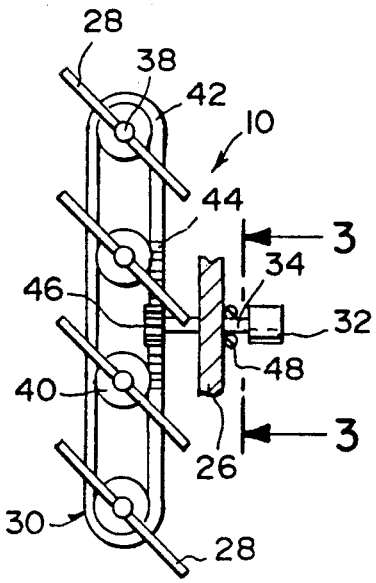

Turning now descriptively to the drawings, in which similar reference characters denote similar elements throughout the several views, the Figures illustrate a removable window safety guard 10 for a window 12 installed in a wall 13 having side jambs 14, a top jamb 16, a sill 18 conjointly defining a window opening 20, a lower window sash 22 and an upper window sash 24 movable mounted within the window opening 20. The safety guard 10 consists of a frame 26 mounted within the window opening 20 between the side jambs 14, when the lower window sash 22 is raised. A plurality of horizontal louvers 28 are mounted within the frame 26 for allowing air to pas therethrough while preventing access of a person therethrough. A mechanism 30 is for opening and closing the louvers 28 within the frame 26. A control knob 32 having a shaft 34 extends through the frame 26, so that the control knob 32 is positioned internally with respect to the window 12, for operating the mechanism 30. A retainer 36 extends between the shaft 34 of the knob 32 and one side jamb 14 of the window 12, for preventing removal of the frame 26 from the window opening 20, so that a child cannot fall out of the window opening 20 and an intruder cannot enter through the window opening 20.

The mechanism 30 includes each louver 28 having a shaft 38 extending between the sides of the frame 26. A sprocket 40 is retained on one end of each shaft 38, so that the sprockets 40 will line up one under the other. A continuous chain 42 having side teeth 44 extends about the sprockets 40. A gear 46 is mounted on a distal end of the shaft 34 of the control knob 32 to engage with the side teeth 44 on the continuous chain 42.

Figure 3:
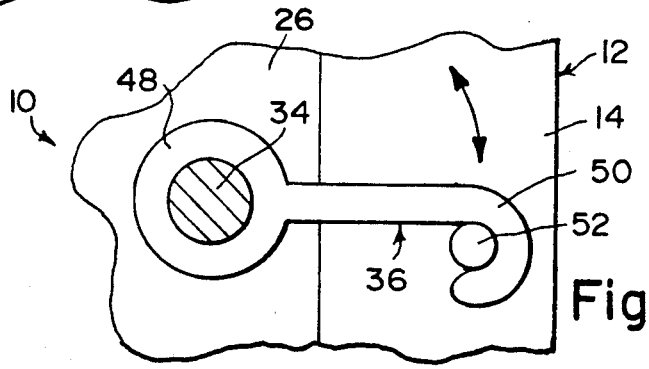
FIG. 3 is an enlarged cross sectional view taken along line 3—3 in FIG. 2, showing the retainer in greater detail.

The retainer 36, as best seen in FIG. 3, includes an eyelet 48 to rotatably fit about the shaft 34 of the control knob 32 at the exterior of the frame 26. A hook member 50 extends from the eyelet 48, while a pin 52 is mounted to the side jamb 14, so that the hook member 50 can releasably engage with the pin 52.

Figure 4:
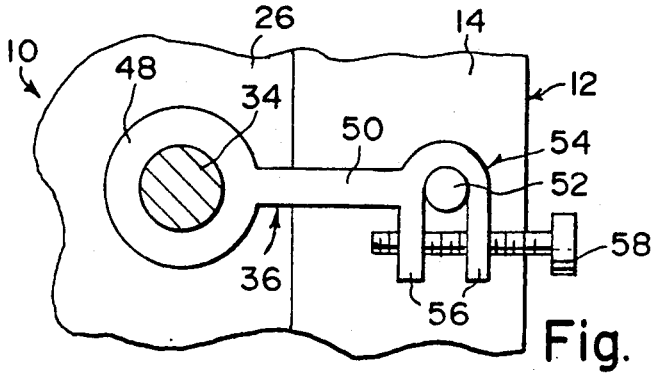
FIG. 4 is an enlarged cross sectional view similar to FIG. 3, showing another type of retainer.

In FIG. 4, the retainer 36 further includes an inverted U-shaped configuration 54 having a pair of arms 56 at a distal end of the hook member 50 opposite from the eyelet 48 to engage with the pin 52. A bolt 58 can extend through the pair of arms 56 to prevent the removal of the hook member 50 from the pin 52 until the bolt 58 is removed therefrom.

A padlock or pin can also be used instead of a bolt 58 to hold the hook member 50 to the pin 52. The retainer 36 can be in higher and lower elevations with respect to the frame 26 and side jamb 14 for security purposes.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A removable window safety guard for a window installed in a building wall having side jambs, a top jamb, a sill conjointly defining a window opening, a lower window sash and an upper window sash movably mounted within the window opening, said safety guard comprising:

a) a frame mounted within the window opening between the side jambs when the lower window sash is raised;

b) a plurality of horizontal louvers mounted within said frame for allowing air to pass therethrough, while preventing access of a person therethrough;

c) a mechanism for opening and closing said louvers within said frame;

d) a rotatable control knob having a shaft axially affixed to said frame, said shaft extending through a snug hole in said frame and connected to said mechanism whereby said knob can rotate in said hole and be retained against linear movement away from said hole and;

e) a retainer between said shaft of said control knob and means on one side jamb, for preventing removal of said frame from the window opening, so that a child cannot fall out of the window opening and an intruder cannot enter through the window opening; wherein said mechanism includes:

f) each said louver having a shaft extending between the sides of said frame;

g) a sprocket retained on one end of each said shaft, so that said sprockets will line up one under the other;

h) a continuous chain having side teeth extending about said sprockets;

i) a gear mounted on a distal end of said shaft of said control knob to engage with said side teeth on said continuous chain, wherein said retainer includes:

j) an eyelet to rotatably fit about said shaft of said control knob, between said frame and said control knob;

k) a hook extending from said eyelet; and l) a pin mounted on said side jamb, whereby said hook is adapted to engage said pin; wherein said retainer further includes:

m) an inverted U-shaped configuration having a pair of arms at a distal end of said hook member opposite from said eyelet to engage with said pin; and n) a bolt to extend through said pair of arms to prevent the removal of said hook member from said pin until said bolt is removed therefrom.

* * * * *